US010953517B2

(12) United States Patent
Faveluke et al.

(10) Patent No.: US 10,953,517 B2
(45) Date of Patent: Mar. 23, 2021

(54) VISE WITH DIAGONALLY ORIENTED TENSIONING SCREW AND LOCKING RACKS

(71) Applicants: Alex Faveluke, Wilsonville, OR (US); Greg Tyler Stephens, Boring, OR (US)

(72) Inventors: Alex Faveluke, Wilsonville, OR (US); Greg Tyler Stephens, Boring, OR (US)

( * ) Notice: Subject to any disclaimer, the term of this patent is extended or adjusted under 35 U.S.C. 154(b) by 182 days.

(21) Appl. No.: 16/129,683

(22) Filed: Sep. 12, 2018

(65) Prior Publication Data

US 2019/0076991 A1 Mar. 14, 2019

Related U.S. Application Data

(60) Provisional application No. 62/558,658, filed on Sep. 14, 2017.

(51) Int. Cl.

| | |
|---|---|
| ***B25B 1/10*** | (2006.01) |
| ***B25B 1/24*** | (2006.01) |
| ***B25B 1/02*** | (2006.01) |
| ***B25B 1/12*** | (2006.01) |

(52) U.S. Cl.

CPC ..... *B25B 1/10* (2013.01); *B25B 1/02* (2013.01); *B25B 1/12* (2013.01); *B25B 1/2489* (2013.01)

(58) Field of Classification Search

CPC .... B25B 1/10; B25B 1/02; B25B 1/12; B25B 1/2489; B25B 1/2426; B25B 1/2442; B25B 1/2473; B25B 1/103; B25B 1/125; B23Q 1/42; B23Q 1/28

See application file for complete search history.

(56) References Cited

U.S. PATENT DOCUMENTS

| | | | | |
|---|---|---|---|---|
| 3,506,253 A * | 4/1970 | Swenson | B23Q 3/06 | 269/137 |
| 4,049,253 A * | 9/1977 | Mandel | B23Q 3/102 | 269/137 |
| 4,562,999 A * | 1/1986 | Ryser | B25B 1/12 | 269/137 |
| 4,986,519 A * | 1/1991 | Lee | B25B 1/10 | 269/137 |
| 5,031,887 A * | 7/1991 | Johanson | B25B 1/10 | 269/137 |
| 5,542,654 A * | 8/1996 | Johanson | B25B 1/10 | 269/137 |
| 7,134,652 B2 * | 11/2006 | Smith | B25B 1/103 | 269/244 |

* cited by examiner

*Primary Examiner* — Tyrone V Hall, Jr.
*Assistant Examiner* — Makena S Markman

(57) ABSTRACT

A vise with a sliding head which slides on an elongate body. A diagonal clamping screw passes through a hole in the sliding head and is threaded into a pin inserted in an internal sliding block. The internal sliding block has a toothed pattern which is able to interlock with a toothed pattern fixed to the body underneath the vise slides. The diagonal clamping screw provides force to lock the tooth patterns together and pull the head forward when tightened. A spring provides force to disengage the internal sliding block teeth and fixed teeth on the body when the diagonal clamping screw is loosened.

8 Claims, 10 Drawing Sheets

VISE WITH DIAGONALLY ORIENTED TENSIONING SCREW AND LOCKING RACKS

RELATED APPLICATIONS

This application claims the benefit and priority of U.S. Provisional Application No. 62/558,658, filed Sep. 14, 2017.

FIELD OF THE INVENTION

The present invention relates to the field of vises and mechanical clamps. More particularly the invention relates to a vise which avoids the need for a long jack screw or lead screw, instead using a single diagonal bolt which pulls a sliding head down to a slide and forward to clamp the workpiece

BACKGROUND

Vises are used in many industrial, commercial, and home settings to securely clamp and hold objects. The object held in a vice is often called the workpiece. Workpieces held in a vise include a very broad range of physical items, all the way from very delicate parts such as balsa wood and plastic modeling shapes, to heavy and rugged items such as iron pipe and metal bars. A very wide variety of vises is used to hold this variety of workpieces.

Slides are the interface between the linear moving and stationary part of a vise. They may be thought of as linear bearings. There are many types of slides. In existing vises today, slides are generally a metal-to-metal sliding joint, which must be greased to prevent friction, loss of clamping force and wear of the sliding joint. These greased slides can be a problem in some industries, such as electronics manufacturing, where it is important to keep the workpiece and general work area clean and free of contamination.

Most vises have a long jackscrew or leadscrew which moves a sliding head, pulling or pushing it toward a fixed block. This long jackscrew can be a disadvantage because it takes up space. Also, there must be room for the handle to be turned. This can interfere with work surfaces and other fixed objects in the work area.

A type of vise often called a "screwless toolmaker's vise" or "grinding vise" is used in surface grinding application and other places where precision and rigidity is desired. An advantage to the toolmaker's vise is that it has external flat sides it may be rested on. Reorienting the entire vise on a surface to gain access to a different side of the workpiece is then easy. One commercially available example of a "screwless toolmaker's vise" is the Starrett Model 581, offered by the The L.S. Starrett Company of Athol Mass. This type of vise will be familiar to those skilled in the art of surface grinding operations.

Screwless toolmaker's vises incorporate a diagonal clamping screw and movable locking pin. The word "screwless" refers to the lack of a jackscrew or leadscrew running the length of the slides. The screwless toolmaker's vise does not have a long handle or jackscrew to get in the way of other objects in the work area; it has a short diagonal screw only. In use, the locking pin is moved to set the vise to a rough clamping range, then the diagonal screw is tightened to move the sliding head forward a small distance and apply clamping force on the workpiece. The diagonal screw pulls the sliding head of the vise both forward and down. Turning the diagonal screw can only pull the sliding head forward for a small distance. The disadvantage to the screwless toolmaker's type vise is the inconvenience of relocating the movable locking pin, re-connecting and retightening the diagonal screw. This can be cumbersome and time consuming. Screwless toolmakers vises available today have metal-to-metal slides which require a thin film of grease or oil to enable sliding contact.

Thus a need in the field exists for a vise having a tightening method that conveniently enables adjustment rough clamping range and clamping force application. Further, a need exists for a vise with flat sides and slide bearing surface that does not require grease or oil for lubrication.

SUMMARY

The invention provides a vise mechanism that uses a diagonal clamping screw. The diagonal screw acts on a pin inserted in an internal sliding block, referred to as the "heart block." Pads with a toothed pattern are mounted to the top side of the heart block and are able to interlock with the teeth on the bottom surface of the vise slides. We refer to these pads as "gripper pads" The teeth on the gripper pads and the teeth on the bottom surface of the vise slides are compatible and lock together horizontally when drawn together vertically. A spring provides tension loading on the diagonal screw, and a stop position takes this tension completely off the diagonal screw when it is loosened sufficiently. The sharp change in state between tension and complete lack of tension applied to the diagonal screw gives tactile feedback to the user of the engaged or completely disengaged state locking rack and gripper pads. When the diagonal screw has no tension from the spring, the gripper pads and locking racks are completely disengaged and the sliding head moves freely along the slides.

BRIEF DESCRIPTION OF THE DRAWINGS

FIG. 2A depicts the diagonal clamping screw. FIG. 2B depicts the sliding head. FIG. 2C depicts the heart block with inserted pin threaded for the clamping screw.

In FIG. 9A, the diagonal screw is tight, pulling the heart block up and the sliding head forward and down. In FIG. 9B the diagonal screw is loose allowing the assembly to freely slide on the body.

DETAILED DESCRIPTION OF A PREFERRED EMBODIMENT

Figure 7:
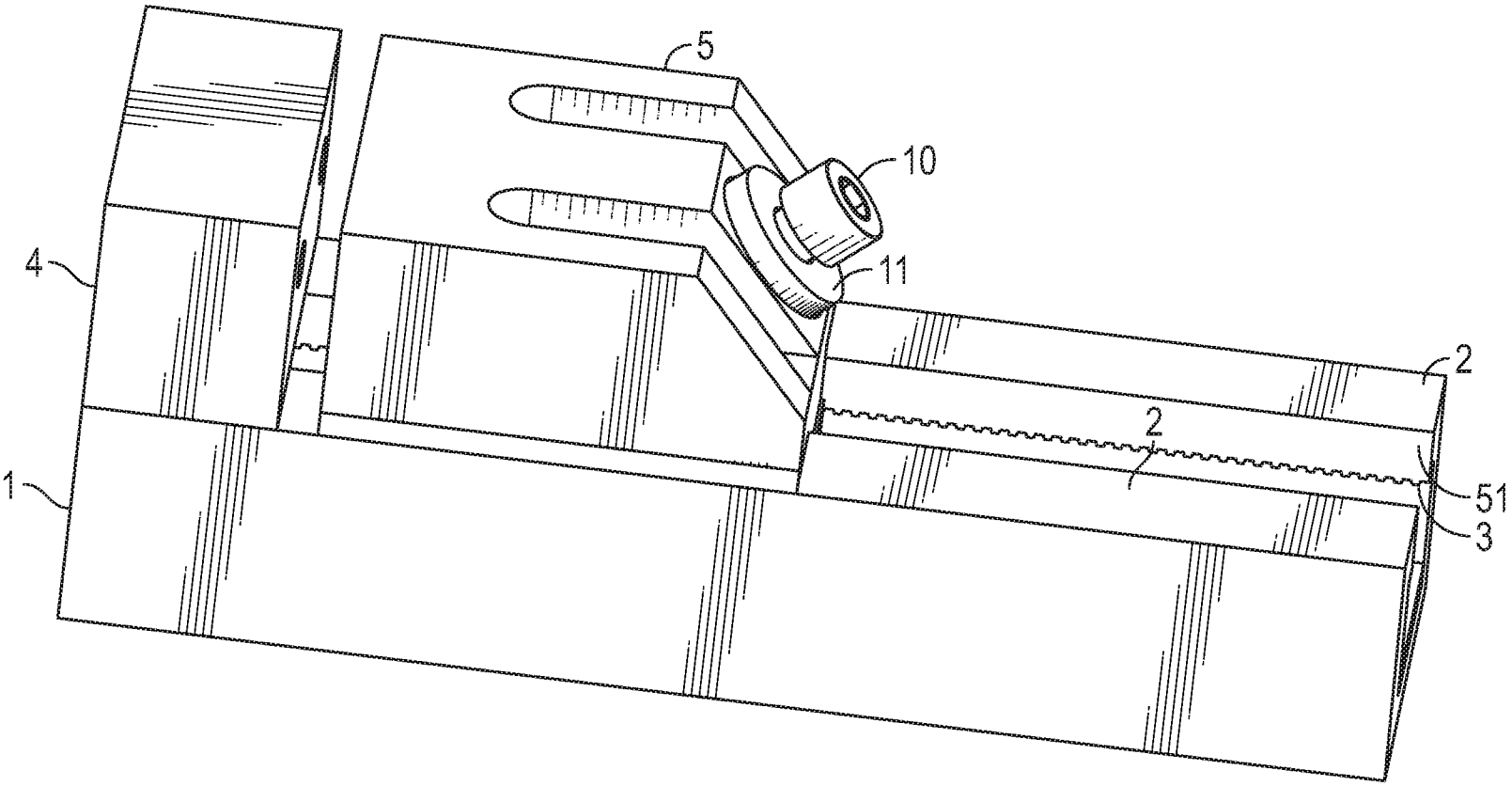
FIG. 7 depicts the assembled vise from the top and side
Figure 8:
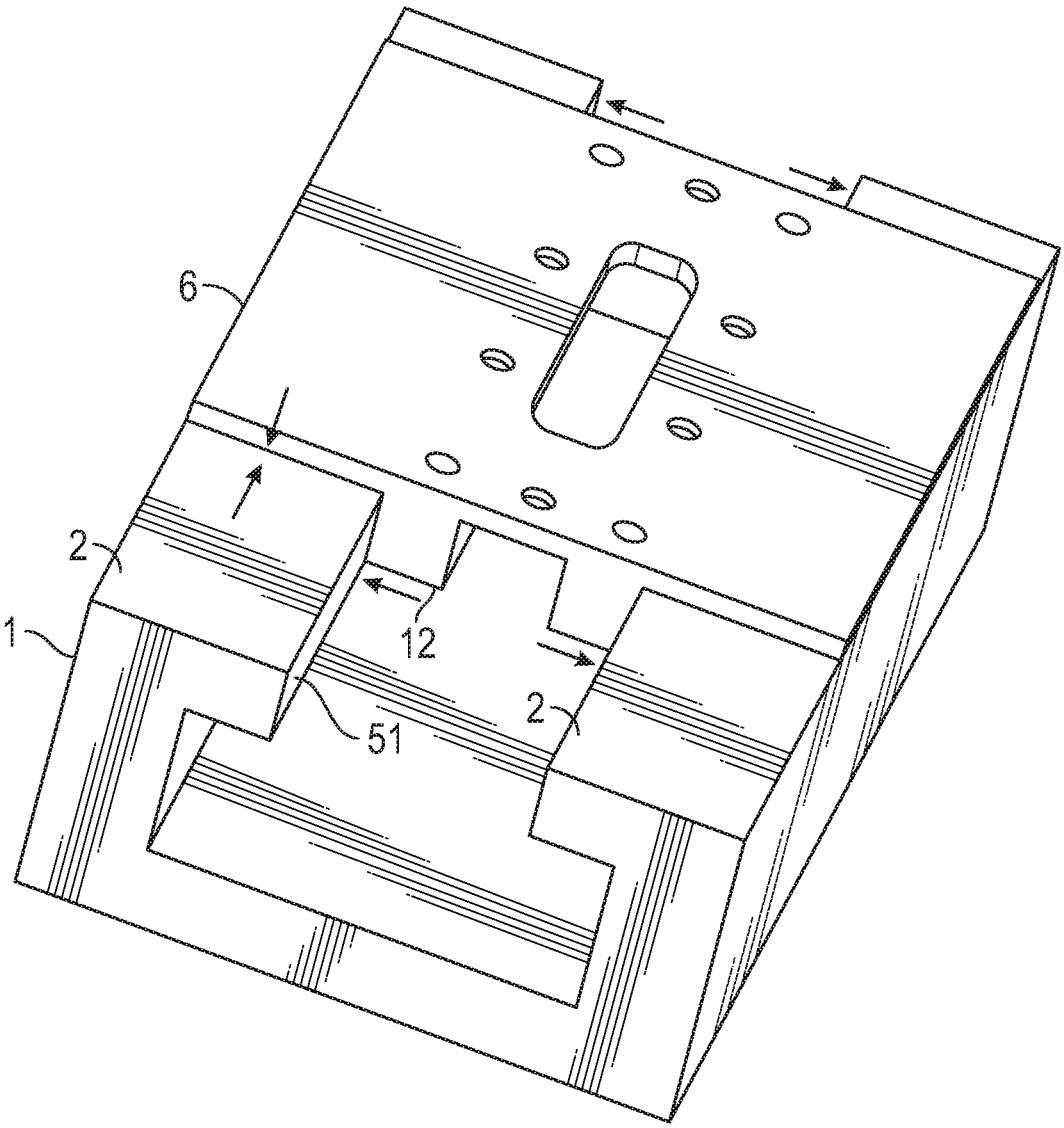
FIG. 8 depicts the sliding bearing surfaces of the body of the vise and the plastic bearing.

Referring to FIG. 7, a preferred embodiment of a vise according to the present invention has a body 1, a fixed head 4, a sliding head 5, and a diagonal clamping screw 10. The body provides smooth horizontal surfaces 2 and smooth vertical surfaces 51. These surfaces are slides which constrain the sliding head to move in a linear fashion. The sliding head is positioned over the body. The head and body are separated by a plastic bearing 6 which is shown in FIG. 8. The plastic bearing is rigidly attached to the sliding head. The plastic bearing has horizontal surfaces that provide low friction contact with the horizontal surfaces 2. The plastic bearing has protrusions 12 that provide low friction contact with the vertical surfaces 51. Pulling the head down towards the surfaces 2 thus fixes the head in both the horizontal and vertical planes of movement. The horizontal surfaces 2 resist what is commonly known as "jaw lift." Jaw lift is an undesirable movement or pivoting of the sliding head of a vise in the vertical direction. The protrusions 12 and vertical surfaces 51 resist what is known as "side play." or undesirable movement of the sliding head in the horizontal plane. Thus the sliding head is restricted to moving in what is effectively a single linear direction.

Figure 1:
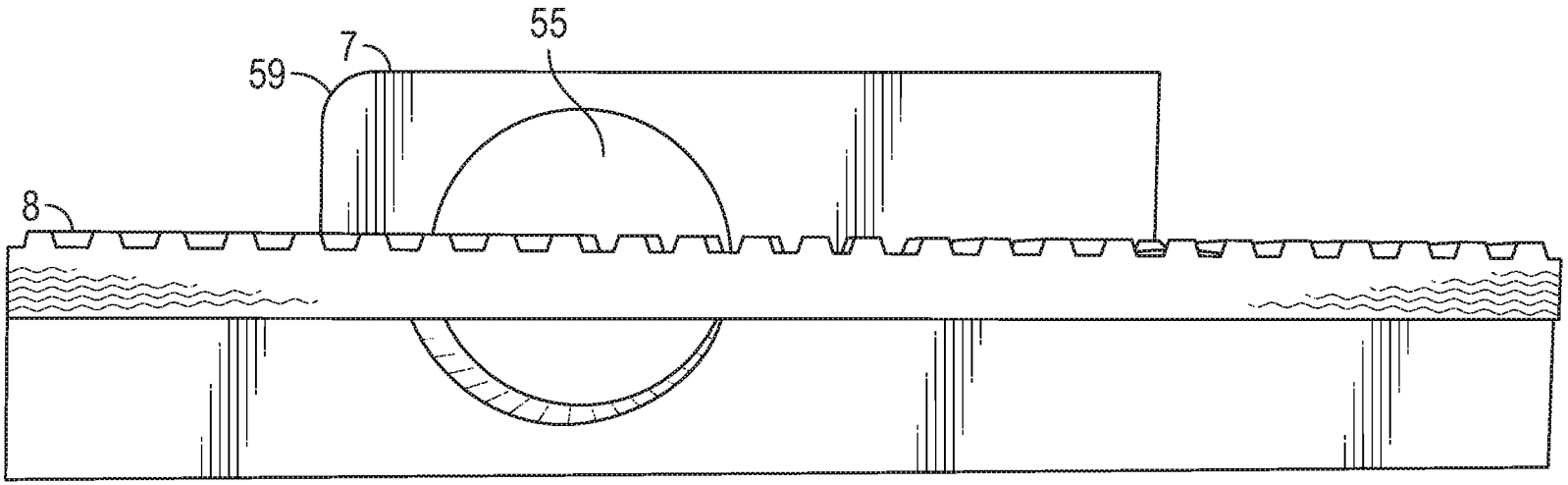
FIG. 1 depicts a side view of the "heart block" which travels lengthwise through the center of the vise body.
Figure 2A:
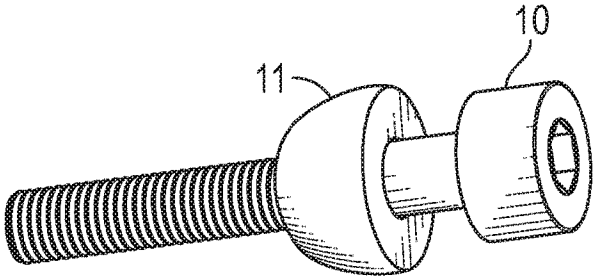
FIGS. 2A-C depict the sliding head, heart block and the diagonal screw that pulls them together.
Figure 2C:
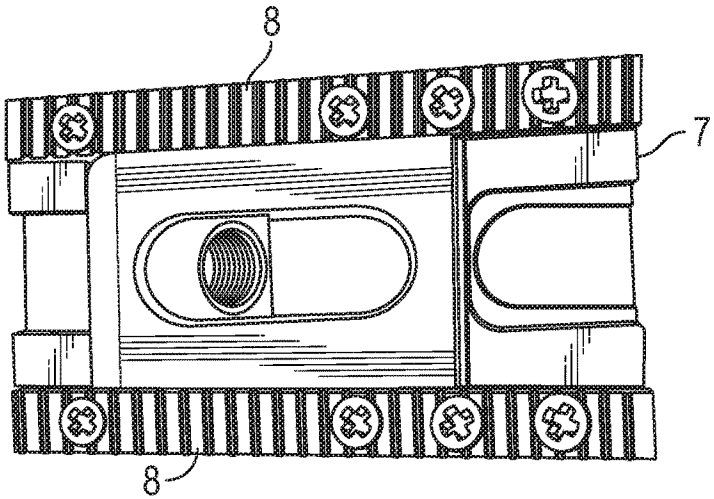
Figure 2B:
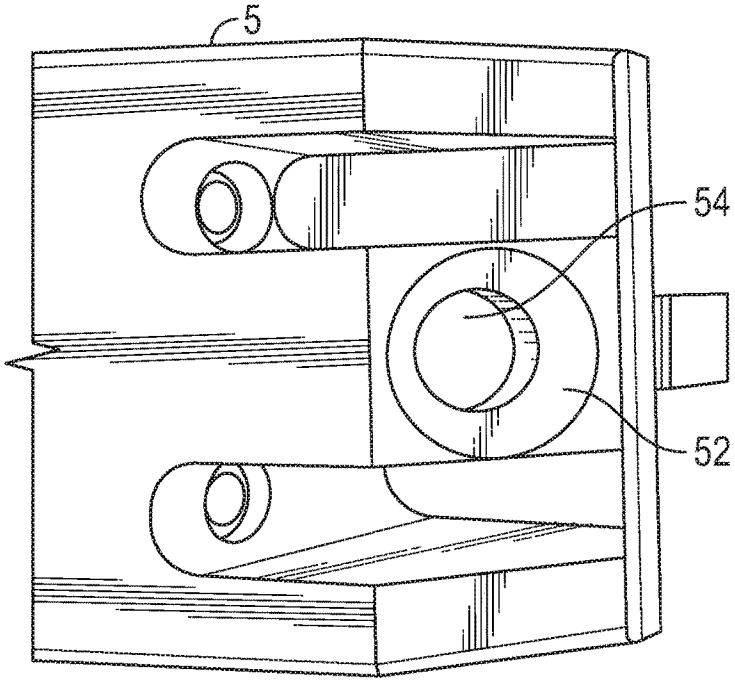
Figure 3:
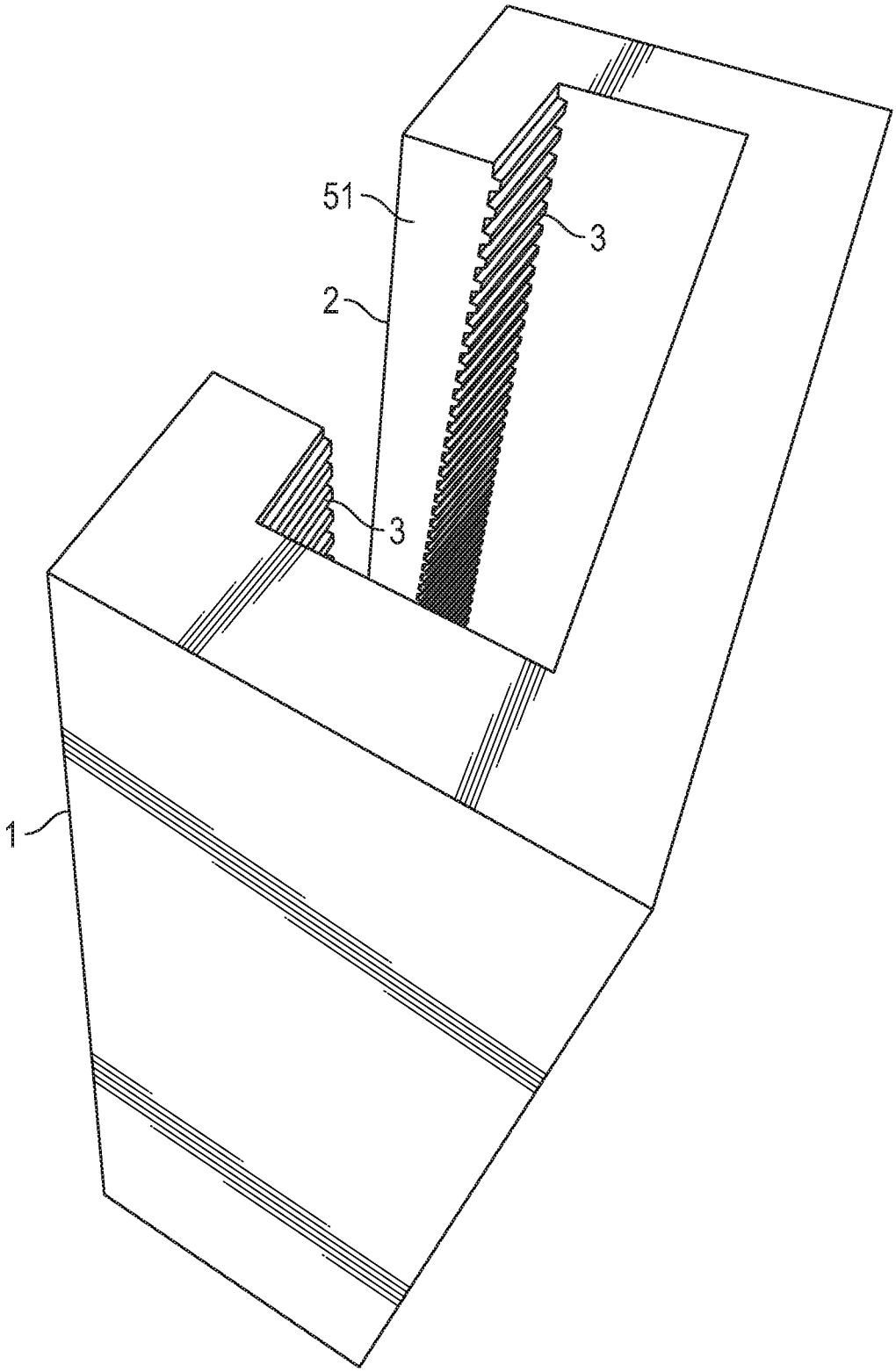
FIG. 3 depicts the main body of the vise, showing the locking racks.
Figure 5:
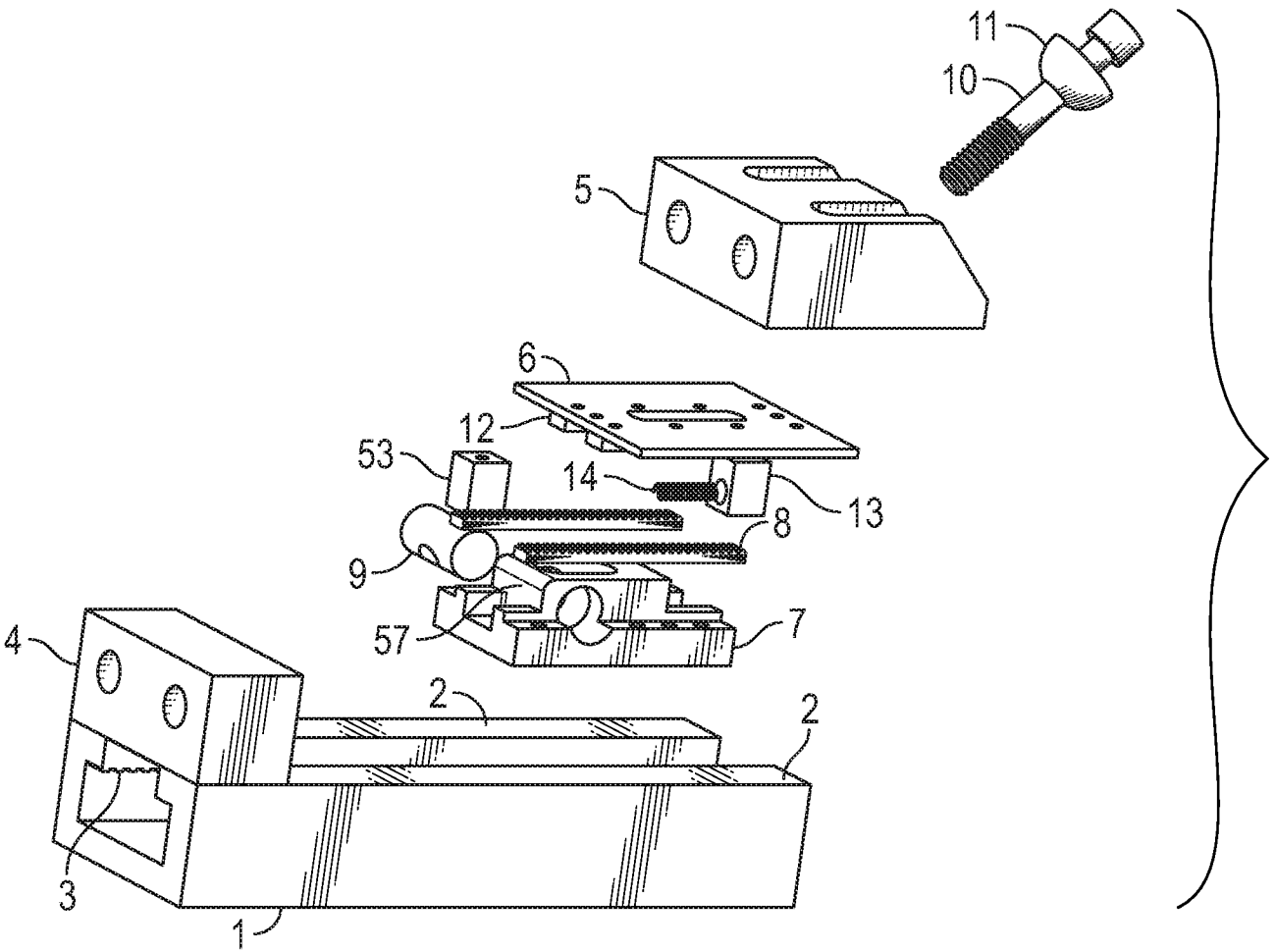
FIG. 5 depicts an exploded view of the vise.
Figure 6:
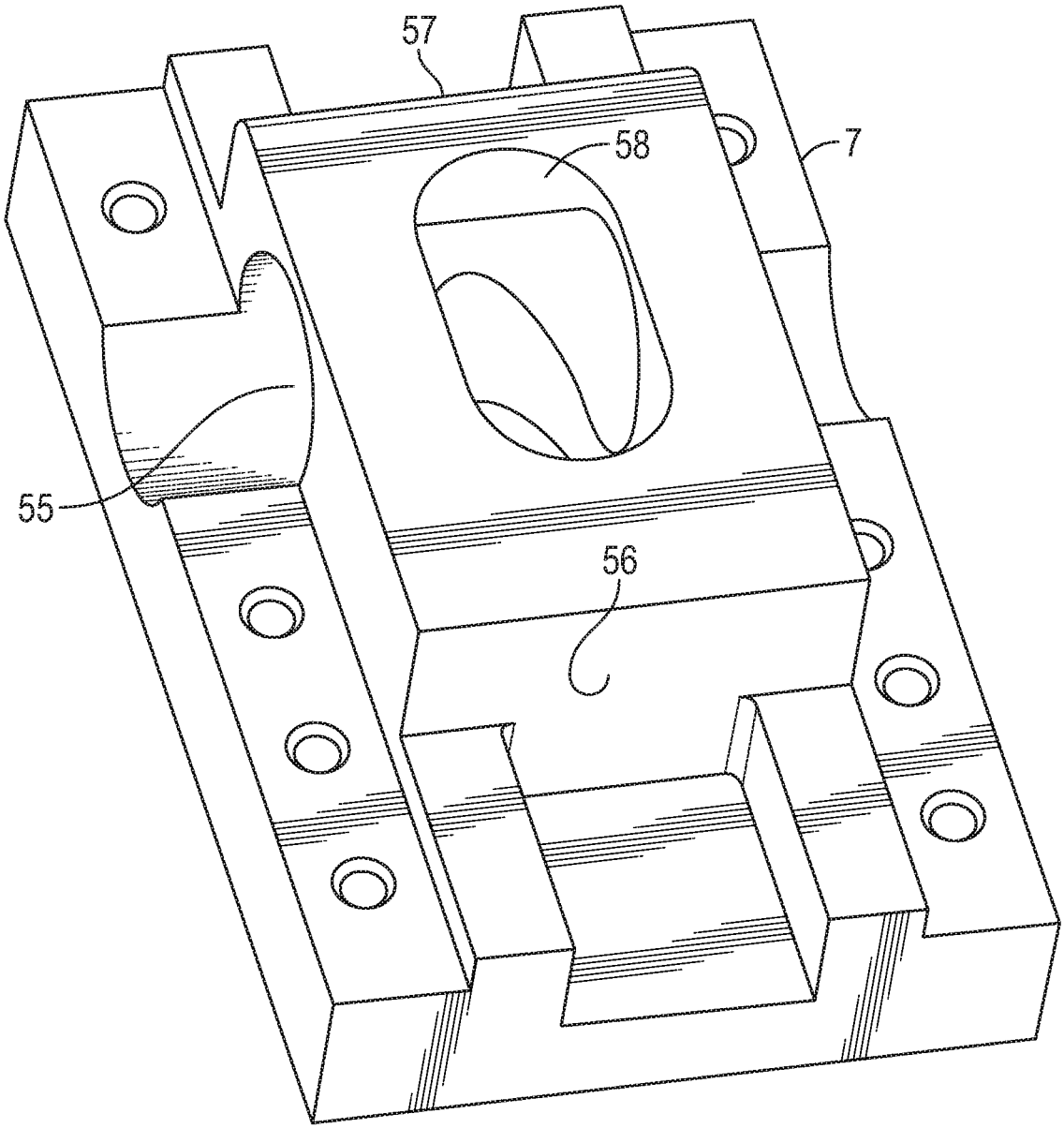
FIG. 6 depicts a view of the heart block from the top side.

Referring to FIG. 3, the body of the vise is open on the top between the sliding surfaces. It has an open space running linearly through it which allows the heart block 7 shown in FIG. 6 to slide through it freely. Referring again to FIG. 3, surfaces parallel to the horizontal sides are machined or formed to create a two locking racks 3. These locking racks mate with gripper pads 8, which are affixed to the heart block. When the gripper pads are pressed into the locking racks, the heart block is restricted from moving. Referring to FIG. 6 a horizontal pivot pin location hole 55 is bored through the heart to admit a pin 9 shown in FIG. 5. Referring to FIG. 2C, this pin is provided with a threaded hole perpendicular to the axis of the pin. The diagonal screw 10 shown in FIG. 2A is used to pull the sliding head shown in 2B diagonally toward the heart block. A spherical recess 52 and drilled half spherical ball 11 are used to provide a pivot point in the sliding head. The diagonal screw can be tightened by the user to pull the sliding head and heart assembly together. The half spherical ball in the sliding head and the pin in the heart allow the screw to pivot slightly in the vertical direction. The oversized hole 54 through the sliding head provides clearance for the screw to pivot on a horizontal axis of the pin and move slightly in the horizontal direction. Slot 58 in the heart block provides clearance for the screw to pivot within the heart block.

Figure 4:
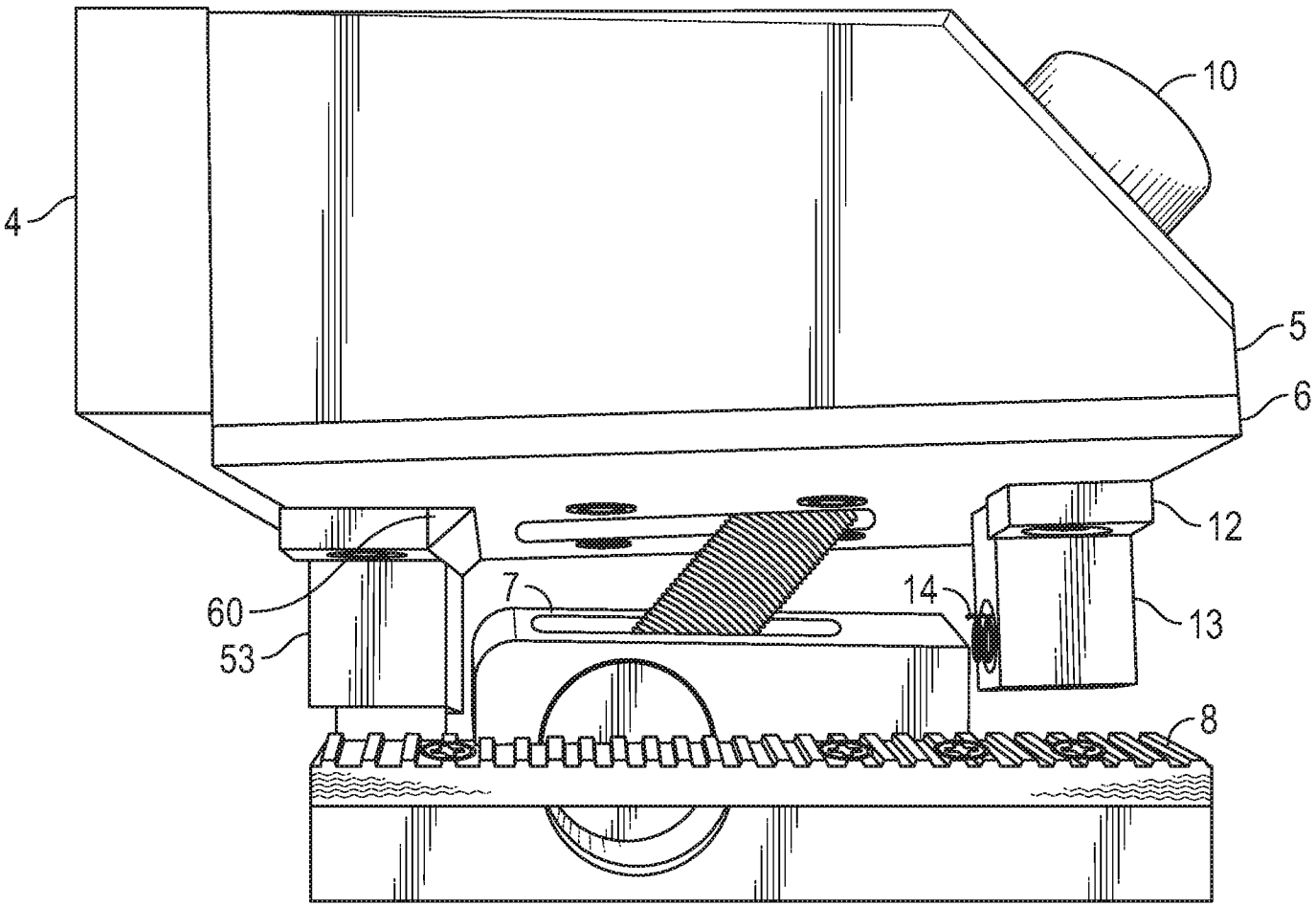
FIG. 4 depicts the sliding head tied to the heart block with the diagonal screw and threaded pin in the heart block. The body is not shown.

Referring to FIG. 4, the sliding head is provided with a spring mount 13, and a front stop 53. The spring mount provides a location to admit a compression spring 14. The spring presses against vertical surface 56 of the heart block most visible in FIG. 6 behind the pivot pin hole 55. A vertical surface 57 is provided which presses against front stop 53 to limit the forward travel of the heart block. Surface 57 is most visible in FIG. 5. It is in front of the pivot pin location hole in the heart block.

Figure 9B:
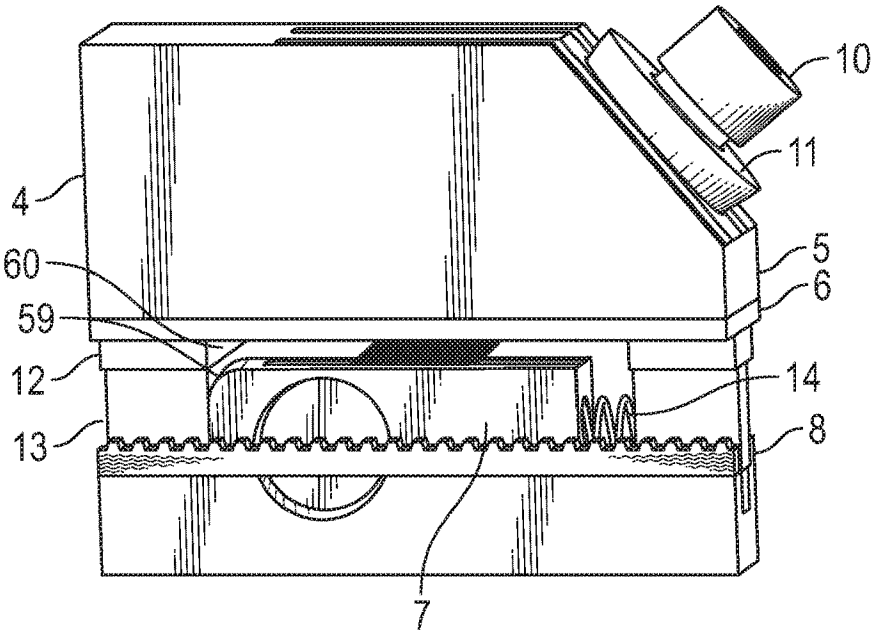
FIGS. 9A-B depict the sliding head and heart block assembly clamped and unclamped.
Figure 9A:
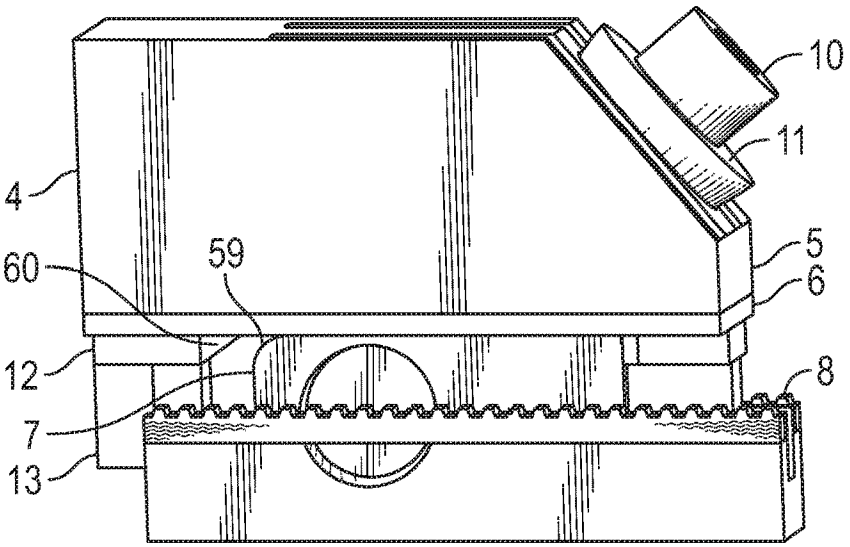

FIGS. 9A-B depict the heart block and sliding head assembly in the clamped and unclamped positions. For clarity the slides are not shown. In the physical vise they are located with the smooth top surface of the slides against the plastic bearing and the teeth of the locking racks on the bottom side of the slides directly over or interlocked with the teeth of the gripper pads. In the clamped position shown in FIG. 9A, the diagonal screw pulls the heart block back and up. The vertical separation distance between the heart block and plastic bearing are decreased. As the vertical separation is decreased the gripper pads mate with the locking rack under the slide surface. The teeth of the gripper pads and locking rack anchor the heart block to the body of the vise, allowing the sliding head to be pulled forward by the diagonal screw without slipping back. The sliding head is then pulled forward by further tightening of the diagonal screw. When the diagonal screw is loosened, the compression spring pushes the heart block forward with respect to the sliding head. The heart block is free to move down and disengage from the locking rack. As the screw is loosened further the front vertical surface of the heart block presses against the front stop. The spring is no longer able to move the heart block forward so all tension which was provided from the action of the spring is removed from the diagonal screw. The action of the spring maintaining the screw in tension provides tactile feedback to the user. When tension abruptly disappears as the screw is loosened the feeling of the completely loose screw indicates to the user that the block is in the loosened position and may be freely slid on the slides.

Figure 10A:
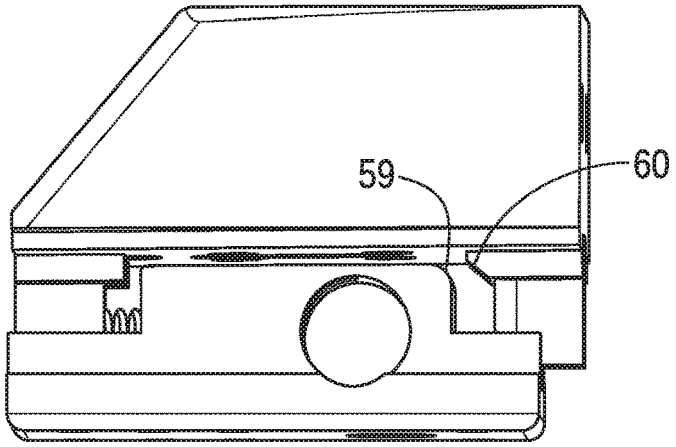
FIGS. 10A-C depict the sliding head and heart block assembly, clamped and unclamped, with particular emphasis on the action of a ramped surface fixed to the sliding head helping to force the heart block down when the spring is allowed to fully extend.
Figure 10B:
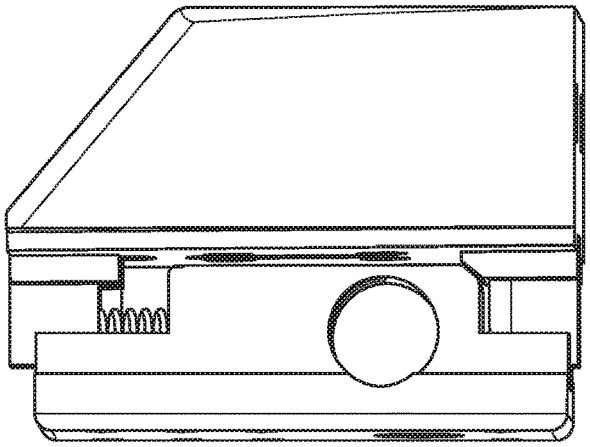
Figure 10C:
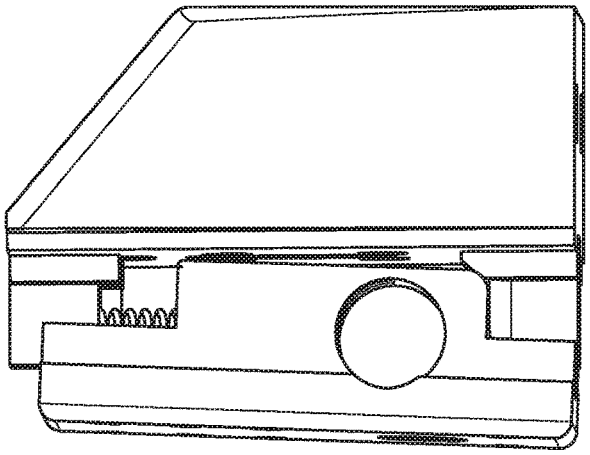

The heart block is pulled downward by gravity when the screw is loosened, separating the teeth of the locking racks from the teeth of the gripper pads. In addition to gravity, force from the spring can be used to aid in separation of the heart block and locking rack. A diagonal surface on 60 fixed to the bottom of the sliding block contacts a curved surface 59 on the heart block when the spring is nearly fully extended. This causes a wedging action pushing the front of the heart block down with force that adds to its weight. This additional force is advantageous to ensure the teeth on the grippers disengage from the teeth on the locking racks. FIGS. 10A-C show the operation of this wedging action. When the screw is tightened, the heart block is pulled back, as in FIG. 10A. Ramp 60 is completely separated from curved surface 59 in this position. In FIG. 10B the screw is loosened, allowing the spring to force the heart block forward until ramp 60 and surface 59 make contact. FIG. 10C shows that as the screw is loosened more, the spring forces the heart block forward and the spring force presses curved surface 59 against ramp 60 pushing the heart block down.

The invention was reduced to practice and a functional prototype was produced as an example of the invention. A description provided with some dimensions follows to help clarify details. The prototype is manufactured to tolerances and surface finishes easily attainable in large volume machining practice.

The prototype is approximately 3 inches wide by 8 inches long. The top slides of the body are approximately 0.375" thick from the top horizontal surface to the locking rack on their bottom surface.

The plastic bearing is attached to the bottom surface of the sliding block by using #6-32 machine screws in eight countersunk clearance holes in the plastic bearing matching up with eight threaded holes in the sliding block. Other attachment methods could be used. The screws in the prototype are flathead screws, the heads of which are recessed under the surface of the plastic bearing.

The prototype uses a locking rack and gripper pads with trapezoidal teeth of a 15 degree pressure angle, having a repeating pattern with linear pitch of 0.120 inches. The total tooth height is 0.030 inches. The open area between each tooth at the base of the teeth is 0.060 inches. The tip of each tooth has a flat of length 0.044 inches. The locking rack is formed directly in the body of the vise, which in the prototype is made of aluminum. The gripper pads are affixed to the heart block with countersunk screws, heads recessed under the surface of the gripper pads. The gripper pads are made from Nylon. The same pattern is used on the mating surfaces of the gripper pads and the locking rack. This pattern allows the teeth to engage and lock when pulled together by the diagonal bolt, but freely release when pressure from the diagonal bolt is loosened.

In the sliding head of the prototype, hole 54 is approximately diameter 0.625 and drilled an angle of 50 degrees to horizontal. The screw in the prototype is 0.375 inch diameter, with 24 threads per inch. The half spherical ball in the prototype is 1.000 inch in diameter and smooth to ordinary commercial ball bearing tolerance and surface finish. The socket in the head is of a diameter slightly larger than the ball, The spherical recess in the prototype has spherical recess diameter of 1.005, so the ball is very freely movable in the socket. At reasonable levels of torque applied to the diagonal screw, the prototype has achieved a measured 1500 pounds of clamping pressure between the sliding head and the fixed head. In the prototype the diagonal screw is capable of moving the sliding head approximately 0.25 inches forward after the gripper pads engage the locking ramps under the slides.

The pin in the heart block is approximately 0.620 inches diameter with a perpendicular hole threaded 3/8/24 threads per inch. The diagonal screw is a commercially available socket head cap screw. An axially drilled knob of cylindrical diameter 1.2 inches and height is attached to the screw to allow moderate tightening and loosening without a separate wrench.

In the prototype, the spring is about 0.25 inches in outer diameter, about 0.75 inches long and provides approximately about 1 pound of horizontal thrust on the heart block in the loose position and about 3 pounds of horizontal thrust on the heart block when the screw is completely tightened.

The invention claimed is:

1. A vise, comprising:

an elongate body portion having a first clamping member and a first locking surface;

a sliding head portion having a second clamping member and configured for linearly sliding on the body portion along a clamping axis extending between the first and second clamping members so as to vary the spacing therebetween, the clamping axis defining a forward direction of travel of the sliding head portion on the body portion by which a spacing between the first and second clamping members is decreased, the sliding head portion further having a through-hole;

a binding portion having a front end and a second locking surface configured for mating engagement with the first locking surface, the front end of the binding portion extending generally in the forward direction of the clamping axis;

a spring defining a spring axis along which the spring provides a spring-bias; and a clamping member spacing-adjustment attachment member, the clamping member spacing-adjustment attachment member being pivotally connected to the binding portion for pivoting about an axis perpendicular to the clamping axis and having a threaded hole for receiving a portion of an adjustment bolt or screw passing loosely through the through-hole of the sliding head portion and threaded into the threaded hole of the clamping member spacing-adjustment attachment member, the sliding head and binding portions being cooperatively configured so that first tightening of the bolt or screw will draw the first and second locking surfaces into mating contact for locking the sliding head and body portions together and thereby establishing a spacing between the first and second clamping members along the clamping axis, whereupon further tightening of the bolt or screw will force the sliding head portion in the forward direction of the clamping axis so as to forcibly reduce said spacing for clamping the workpiece, and wherein the spring is disposed between the sliding head portion and the binding portion so that the spring-bias biases the front end of the binding portion to move farther away from the sliding head portion in said forward direction, and the spring axis is substantially parallel to the clamping axis.

2. The vise of claim 1, wherein the binding portion has a back end opposite the front end, the front end of the binding portion and the front end of the sliding head portion have respective ramping surfaces, and the sliding head and binding portions are cooperatively configured so that loosening the adjustment bolt or screw allows the binding portion to fall in a downward direction relative to the sliding head portion under the influence of gravity so as to effectuate a disengagement of the locking surfaces, wherein said disengagement of the locking surfaces frees the at least one spring to move the binding portion in the forward direction relative to the sliding head portion and to bring the ramping surfaces into engagement, and wherein the ramping surfaces are cooperatively configured, and the spring-bias provided by the at least one spring is sufficient, to force the front end of the binding portion, relative to the back end of the binding portion, further in the downward direction.

3. The vise of claim 2, wherein the sliding head portion includes a stop that limits the amount the binding portion can move in the forward direction of travel relative to the sliding head portion.

4. The vise of claim 1, wherein the sliding head portion includes a stop that limits the amount the binding portion can move in the forward direction of travel relative to the sliding head portion.

5. The vise of claim 4, wherein at least one of the first and second locking surfaces are non-metallic.

6. The vise of claim 3, wherein at least one of the first and second locking surfaces are non-metallic.

7. The vise of claim 2, wherein at least one of the first and second locking surfaces are non-metallic.

8. The vise of claim 1, wherein at least one of the first and second locking surfaces are non-metallic.

* * * * *